US007843291B2

(12) United States Patent
Titus

(10) Patent No.: US 7,843,291 B2
(45) Date of Patent: Nov. 30, 2010

(54) INTEGRATED MAGLATCH ACCESSORY

(75) Inventor: Solomon R. Titus, Alpharetta, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 11/710,025

(22) Filed: Feb. 23, 2007

(65) Prior Publication Data

US 2007/0194869 A1 Aug. 23, 2007

Related U.S. Application Data

(60) Provisional application No. 60/776,097, filed on Feb. 23, 2006.

(51) Int. Cl.
*H01H 67/02* (2006.01)
*H01H 9/02* (2006.01)
*H01H 13/04* (2006.01)

(52) U.S. Cl. ..... 335/132; 335/202

(58) Field of Classification Search ..... 335/132, 335/202

See application file for complete search history.

(56) References Cited

U.S. PATENT DOCUMENTS 4,104,601 A 8/1978 Gryctko
4,250,532 A 2/1981 Davis
4,595,812 A * 6/1986 Tamaru et al. ..... 200/307
4,679,019 A 7/1987 Todaro et al.
4,774,484 A * 9/1988 Lehman et al. ..... 335/197
4,884,048 A * 11/1989 Castonguay et al. ..... 335/18
4,939,490 A * 7/1990 Bernier et al. ..... 335/17
5,075,658 A * 12/1991 Lesslie et al. ..... 335/14
5,107,236 A * 4/1992 Lesslie et al. ..... 335/132
5,153,544 A * 10/1992 Castonguay et al. ..... 335/167
5,252,937 A * 10/1993 Bernier et al. ..... 335/202
5,488,338 A * 1/1996 Seymour et al. ..... 335/202
5,539,168 A * 7/1996 Linzenich ..... 200/303
5,581,219 A * 12/1996 Nozawa et al. ..... 335/132
5,611,120 A 3/1997 Riceman et al.
5,652,420 A * 7/1997 Innes et al. ..... 200/50.32
6,104,265 A * 8/2000 Maloney et al. ..... 335/13
6,211,758 B1 * 4/2001 Castonguay et al. ..... 335/202
6,310,753 B1 10/2001 Dollar, II et al.
6,421,217 B1 * 7/2002 Castonguay et al. ..... 361/115
6,441,708 B1 * 8/2002 Rodriguez et al. ..... 335/172
6,548,769 B2 * 4/2003 Nomura et al. ..... 200/18
6,597,266 B1 * 7/2003 Rodriguez et al. ..... 335/132
6,600,396 B1 7/2003 Rodriguez et al.
6,624,731 B2 * 9/2003 Passow et al. ..... 335/202

(Continued)

*Primary Examiner*—Elvin G Enad
*Assistant Examiner*—Alexander Talpalatskiy
(74) *Attorney, Agent, or Firm*—Jose de la Rosa

(57) ABSTRACT

An apparatus for indicating a condition of a molded case circuit breaker, with the circuit breaker defining an accessory pocket in communication with an operating mechanism and a trip unit of the circuit breaker, including a mount member operatively coupled to one of the operating mechanism and trip unit in the accessory pocket. A housing coupled to the mount member, with the housing defining a compartment. A magnetic latch device disposed in the compartment and operatively coupled to the mount member. A switch disposed in the compartment and operatively coupled to the mount member. Wherein a condition of the circuit breaker is indicated by a condition of one of the switch and magnetic latch, and the condition of the circuit breaker is operatively transmitted via the apparatus to a remote location.

13 Claims, 4 Drawing Sheets

U.S. PATENT DOCUMENTS

| | | | | |
|---|---|---|---|---|
| 6,717,775 | B2 | 4/2004 | Ong et al. | |
| 6,778,048 | B1 * | 8/2004 | Brignoni et al. | 335/132 |
| 6,831,534 | B2 * | 12/2004 | Rodriguez et al. | 335/132 |
| 6,867,671 | B2 * | 3/2005 | Rodriguez et al. | 335/132 |
| 6,943,652 | B2 * | 9/2005 | Rodriguez et al. | 335/6 |
| 7,064,635 | B2 * | 6/2006 | Bogdon et al. | 335/6 |
| 2003/0206092 | A1 * | 11/2003 | Rodriguez et al. | 337/79 |
| 2004/0066260 | A1 * | 4/2004 | Rodriguez et al. | 335/172 |
| 2004/0227601 | A1 * | 11/2004 | Brignoni et al. | 335/172 |
| 2005/0128034 | A1 * | 6/2005 | Rodriguez et al. | 335/167 |
| 2005/0200439 | A1 * | 9/2005 | Kawahara et al. | 335/128 |

* cited by examiner

INTEGRATED MAGLATCH ACCESSORY

CROSS-REFERENCE TO RELATED PATENT APPLICATIONS

This application claims priority from U.S. Provisional Application No. 60/776,097, filed Feb. 23, 2006, incorporated herein by reference in its entirety.

FIELD OF THE INVENTION

The present invention relates generally to the field of circuit breakers, and more particularly to a molded case circuit breaker with a signal accessory.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as 250 amps. The tripping mechanism for the breaker usually consists of a thermal overload release and a magnetic short circuit release. The thermal overload release operates by means of a bimetallic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as for the period of time that that current is flowing. For a given range of current ratings, the bi-metal cross-section and related elements are specifically selected for such current range resulting in a number of different circuit breakers for each current range.

In the event of current levels above the normal operating level of the thermal overload release, it is desirable to trip the breaker without any intentional delay, as in the case of a short circuit in the protected circuit, therefore, an electromagnetic trip element is generally used. In a short circuit condition, the higher amount of current flowing through the circuit breaker activates a magnetic release which trips the breaker in a much faster time than occurs with the bi-metal heating. It is desirable to tune the magnetic trip elements so that the magnetic trip unit trips at lower short circuit currents at a lower continuous current rating and trips at a higher short circuit current at a higher continuous current rating. This matches the current tripping performance of the breaker with the typical equipment present downstream of the breaker on the load side of the circuit breaker.

In certain situations, an operator of an electrical system may desire to know if a circuit breaker is open, closed or tripped from a remote location. Such circumstances can include applications for maintenance and control. It may also be used in applications to provide synchronizing of several breakers, together with other accessories, to open and close several circuit breakers. One device used for signaling the state of a circuit breaker from a remote location is a signal accessory such as a bell switch or an auxiliary switch. Existing signal accessories currently used have several disadvantages. Some such signal accessory accessories must be installed in the circuit breaker housing behind the main cover and in close proximity to electrically live parts and connections. Other signal accessory accessories require the user to provide terminal connections to the switch wires. Further examples of present signal device accessories are designed to be used with a single circuit breaker frame, i.e., for each current rating of the circuit breaker a specially designed signal device accessory is required.

In certain situations, a circuit breaker may include a magnetic latch as an accessory installed in the circuit breaker housing also behind the main cover of the circuit breaker. The magnetic latch is typically installed in an accessory pocket of the circuit breaker thereby eliminating an accessory pocket position for auxiliary switches and bell alarm switches, or other accessories.

Thus, there is a need for an integrated arrangement of a magnetic latch and multiple switches to be installed in a circuit breaker housing to accommodate the various indications and functions of such accessories. There is a further need for a signal device that can be used with several circuit breaker frame sizes, that is, a single signal accessory that will operate over a wide range of current ratings for the circuit breaker. There is an additional need for a signal accessory with which the customer can connect its control wiring directly to the signal device without any additional rewiring. There is a further need for a signal accessory that can provide an indication of the condition of the circuit breaker, for example, is the circuit breaker open, closed, or in a tripped position.

SUMMARY OF THE INVENTION

There is provided an apparatus for indicating a condition of a molded case circuit breaker, with the circuit breaker defining an accessory pocket in communication with an operating mechanism and a trip unit of the circuit breaker, including a mount member operatively coupled to one of the operating mechanism and trip unit in the accessory pocket. A housing coupled to the mount member, with the housing defining a compartment. A magnetic latch device disposed in the compartment and operatively coupled to the mount member. A switch disposed in the compartment and operatively coupled to the mount member. Wherein a condition of the circuit breaker is indicated by a condition of one of the switch and magnetic latch, and the condition of the circuit breaker is operatively transmitted via the apparatus to a remote location.

There is further provided a circuit breaker including a housing including a cover. A first terminal and a second terminal mounted in the housing. A contact electrically coupled to the first terminal. A movable contact electrically coupled to the second terminal. An operating mechanism mounted in the housing and coupled to the movable contact. A trip unit coupled to the movable contact and the second terminal. An accessory pocket defined in the cover, with the accessory pocket in communication with the operating mechanism and trip unit, and configured to accept an accessory apparatus, with the accessory apparatus including a mount member operatively coupled to one of the operating mechanism and trip unit in the accessory pocket. A housing coupled to the mount member, with the housing defining a compartment. A magnetic latch device disposed in the compartment and operatively coupled to the mount member. A switch disposed in the compartment and operatively coupled to the mount member. A condition of the circuit breaker is indicated by a condition of one of the switch and magnetic latch, and the condition of the circuit breaker is operatively transmitted via the apparatus to a remote location.

There is further provided a method for maximizing utilization of an accessory pocket in a circuit breaker, the circuit breaker including an operating mechanism and a trip unit in communication with the accessory pocket providing a housing defining a compartment. Installing a magnetic latch device including a reset lever in the compartment. Installing at least two switches in the compartment. Coupling the housing to a mount member, with the mount member including an actuator configured to selectively couple with at least one of the switches. Installing the mount member in the accessory pocket and aligning the actuator with one of the operating mechanism and trip unit. Wherein the use of the accessory pocket is maximized by integrating the magnetic latch device and switches in a single housing mounted in the accessory pocket.

DETAILED DESCRIPTION OF THE EXEMPLARY EMBODIMENTS

Figure 4:
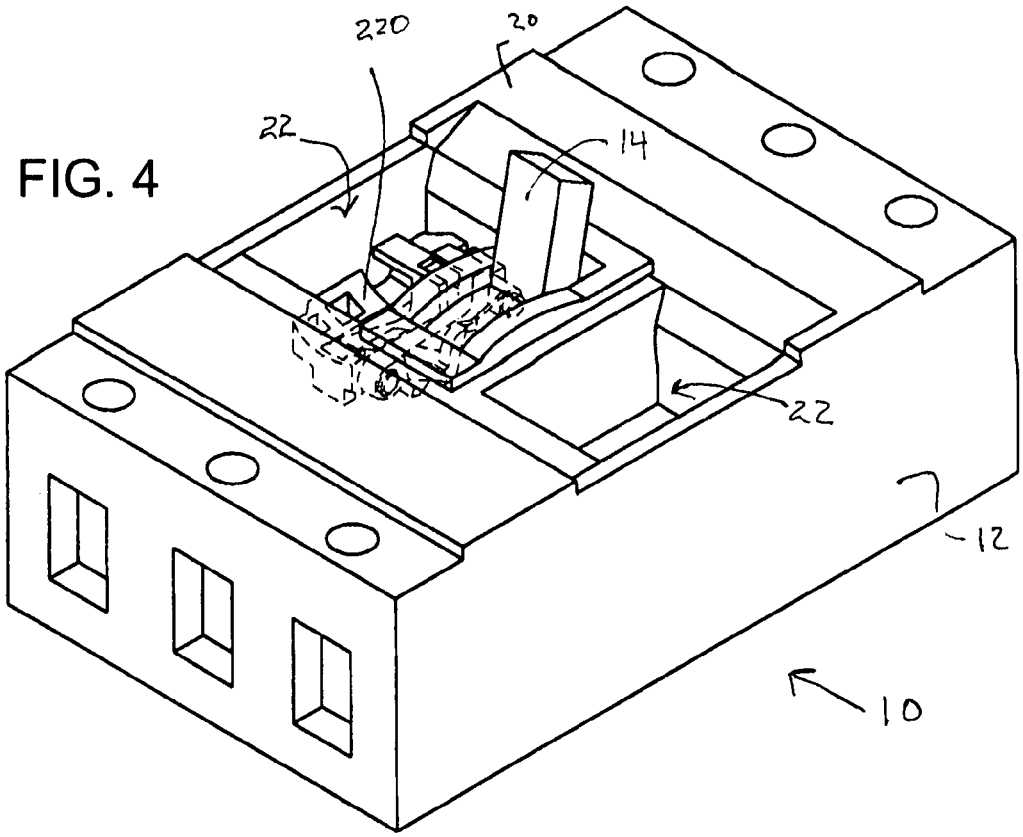
FIG. 4 is a perspective view of an exemplary embodiment of the circuit breaker with the mount assembly illustrated in FIG. 2 disposed in an accessory pocket defined in the circuit breaker housing.
Figure 5:
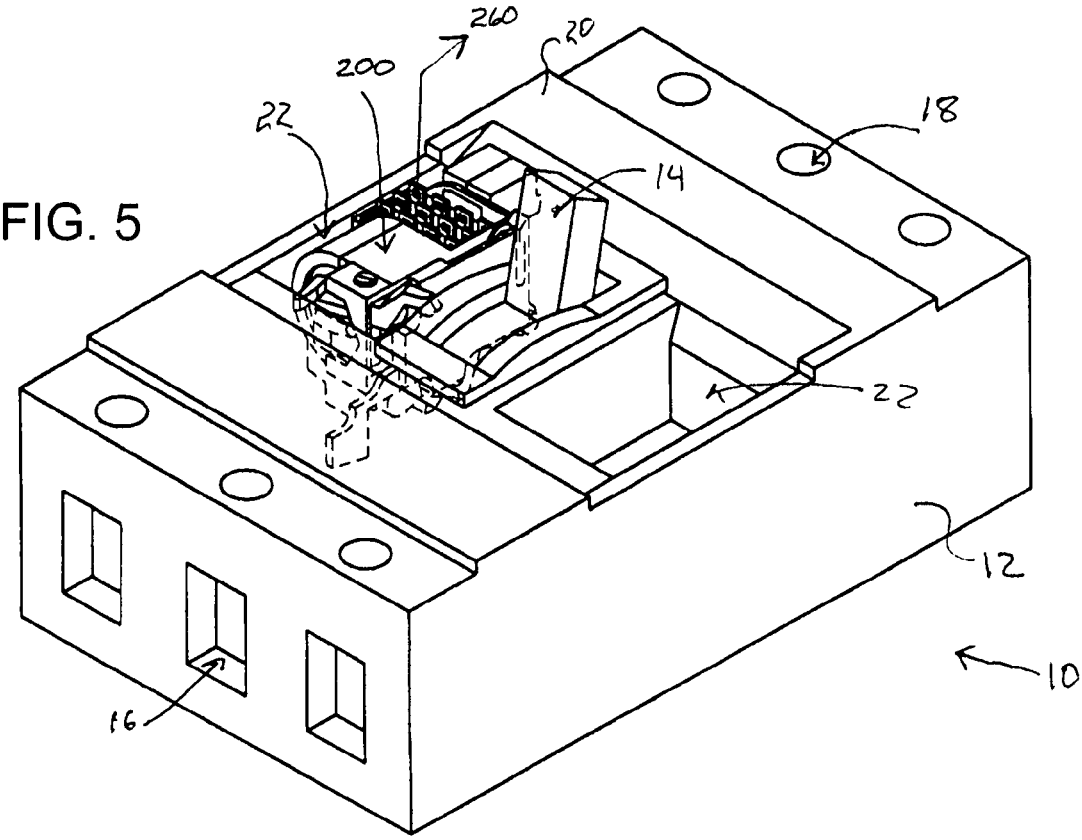
FIG. 5 is a perspective view of the circuit breaker illustrated in FIG. 4 with the integrated magnetic latch assembly mounted on the mount assembly illustrated in FIG. 4.
Figure 6:
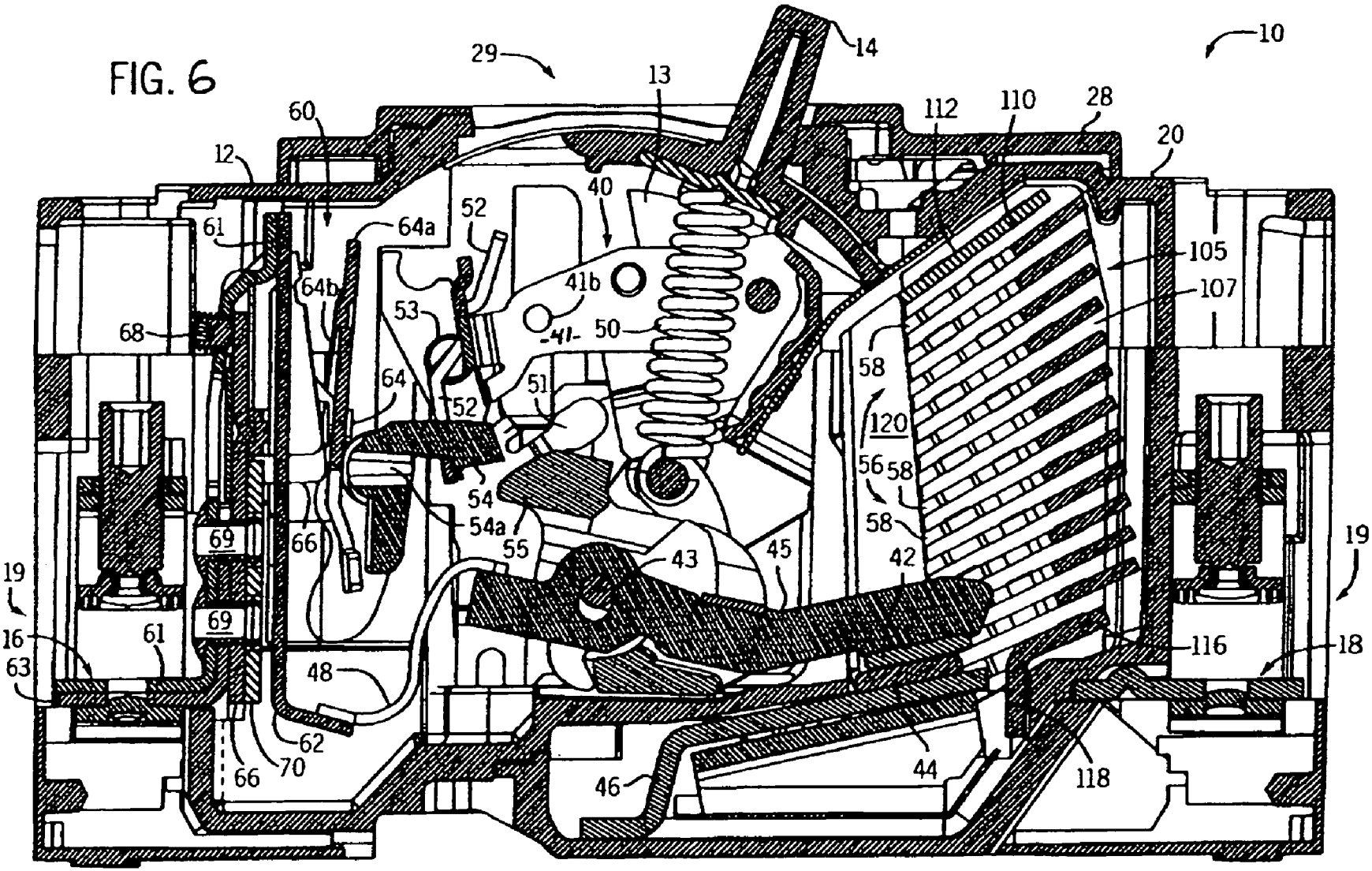
FIG. 6 is a sectional view of the circuit breaker shown in FIG. 5 as used to describe the operation of the circuit breaker.

FIGS. 4-6 generally illustrates a three phase molded case circuit breaker 10 of the type which includes an operating mechanism 40 having a pivoting member 13 with a handle 14. The pivoting member 13 and handle 14 are moveable between an ON position, an OFF position and a TRIPPED position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Referring to FIG. 6, handle 14 is operable between the ON and OFF positions to enable a contact operating mechanism 40 to engage and disengage a moveable contact 42 and a stationary contact 44 for each of the three phases, such that the line terminal 18 and load terminal 16 of each phase can be electrically connected. The circuit breaker housing 12 includes three portions which are molded from an insulating material. These portions include a circuit breaker base 12, a main circuit breaker cover 20 and an accessory cover 28, with the main breaker cover 20 and the accessory cover 28 having an opening 29 for the handle 14 of the pivoting member 13. The pivoting member 13 and handle 14 move within the opening 29 during the several operations of the circuit breaker 10. FIG. 6 is a cut away view of the circuit breaker 10 shown in FIGS. 4 and 5. As shown in FIG. 6, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44.

The operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus 46 are contained in an arc chamber 56. Each pole of the circuit breaker 10 is provided with an arc chamber 56 which is molded from an insulating material and is part of the circuit breaker 10 housing 12. A plurality of arc plates 58 are maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40.

The exemplary intermediate latch 52 is generally Z-shaped having an upper leg which includes a latch surface that engages the cradle 41 and a lower leg having a latch surface which engages a trip bar 54. The center portion of the Z-shaped intermediate latch element 52 is angled with respect to the upper and lower legs and includes two tabs which provide a pivot edge for the intermediate latch 52 when it is inserted into the mechanical frame 51. As shown in FIG. 6, the intermediate latch 52 is coupled to a torsion spring 53 which is retained in the mechanical frame 51 by the mounting tabs of the intermediate latch 52. The torsion spring 53 biases the upper latch surface of the intermediate latch 52 toward the cradle 41 while at the same time biasing the trip bar 54 into a position which engages the lower latch surface of the intermediate latch 52. The trip bar 54 pivots in a counter clockwise direction about an axis 54*a*, responsive to a force exerted by a bimetallic element 62, during, for example, a long duration over current condition. As the trip bar 54 rotates, in a counter clockwise direction, the latch surface on the upper portion of the trip bar disengages the latch surface on the lower portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact arms 46.

During normal operation of the circuit breaker, current flows from the line terminal 18 through the line contact arm 46 and its stationary contact pad 44 to the load contact arm 45 through its contact pad 42. From the load contact arm 45, the current flows through a flexible braid 48 to the bimetallic element 62 and from the bimetallic element 62 to the load terminal 16. When the current flowing through the circuit breaker exceeds the rated current for the breaker, it heats the bimetallic element 62, causing the element 62 to bend towards the trip bar 54. If the over current condition persists, the bimetallic element 62 bends sufficiently to engage the trip bar surface. As the bimetallic element engages the trip bar surface and continues to bend, it causes the trip bar 54 to rotate in a counter clockwise direction releasing the intermediate latch 52 and thus unlatching the operating mechanism 40 of the circuit breaker.

In the exemplary circuit breaker 10, the cross bar 55 is coupled to the operating mechanism 40, which is held in place in the base or housing 12 of the molded case circuit breaker 10 by a mechanical frame 51. The key element of the operating mechanism 40 is the cradle 41. As shown in FIG. 6, the cradle 41 includes a latch surface which engages the upper latch surface in the intermediate latch 52. The intermediate latch 52 is held in place by its mounting tabs which extend through the respective openings on either side of the mechanical frame 51. In the exemplary embodiment of the circuit breaker, the two side members of the mechanical frame 51 support the operating mechanism 40 of the circuit breaker 10 and retain the operating mechanism 40 in the base 12 of the circuit breaker 10.

FIGS. 4, 5 and 6 illustrate the main circuit breaker 10 and cover 20. The breaker cover 20, in the preferred embodiment, has two accessory sockets 22 formed in the cover 20, with one accessory socket 22 on either side of the opening 29 for the pivoting member 13 and handle 14. The breaker cover 20 with the accessory sockets 22 or compartments can be formed, usually by well known molding techniques, as an integral unit. The accessory socket 22 can also be fabricated separately and attached to the breaker cover 20 by any suitable method such as with fasteners or adhesives. The breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14.

Each accessory socket or compartment 22 is provided with a plurality of openings. The accessory socket openings are positioned in the socket 22 to facilitate coupling of an accessory, also referred to as an apparatus, 200 with the operating mechanism 40 mounted in the housing 12. The accessory socket openings also facilitate simultaneous coupling of an accessory 200 with different parts of the operating mechanism 40. Various accessories 200 can be mounted in the accessory compartment 22 to perform various functions. Some accessories, such as an auxiliary switch, provides a signal indicating the status of the circuit breaker 10, e.g. "on" or "off". When the auxiliary switch is nested in the accessory socket 22, a member on the mounting member 220 protrudes through one of the openings in the socket 22 and is in engagement with the operating mechanism 40, typically the cross bar 55. Multiple switches can be nested in one accessory socket 22 and each switch can engage the operating mechanism through a different opening in the socket 22.

Figure 1:
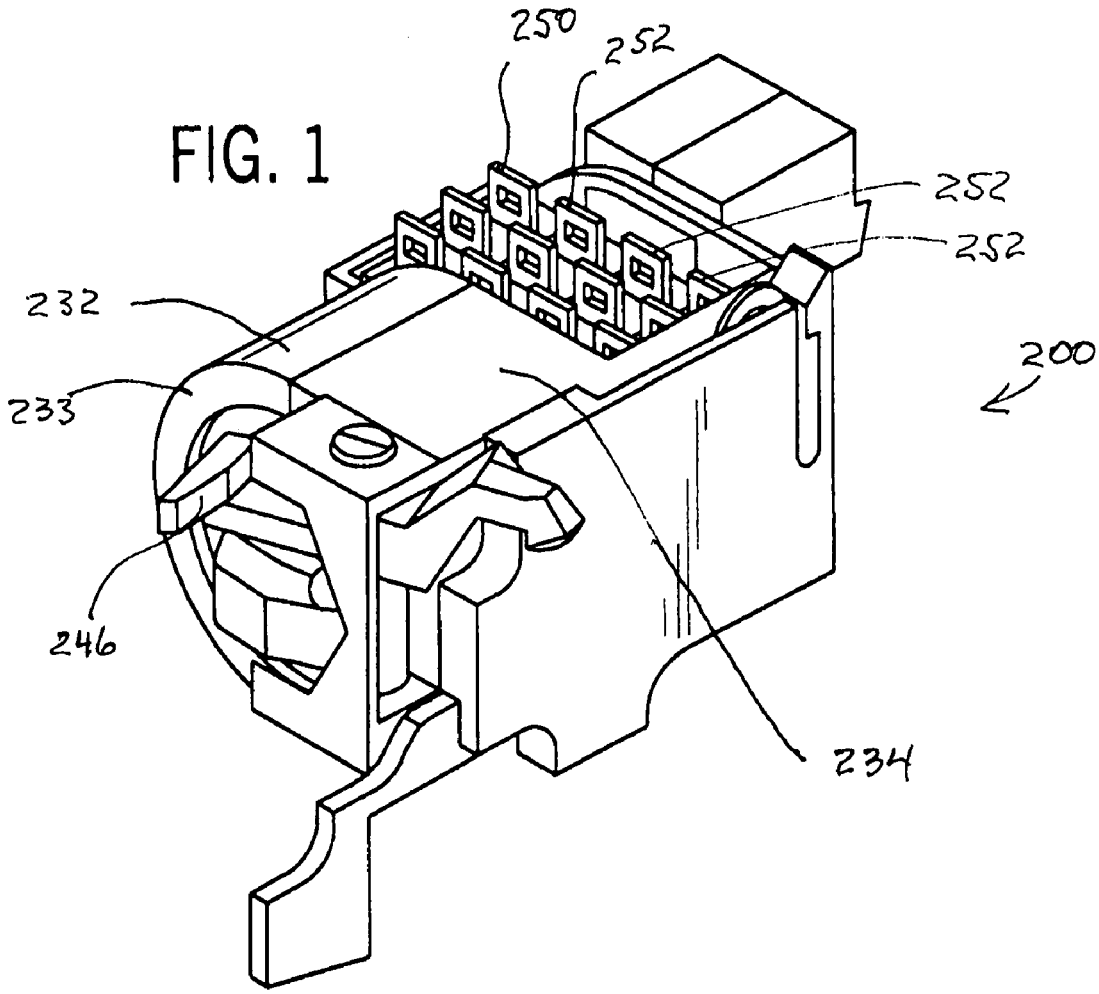
FIG. 1 is an exemplary embodiment of an integrated maglatch assembly including a maglatch and a plurality of switches disposed in a housing.
Figure 2:
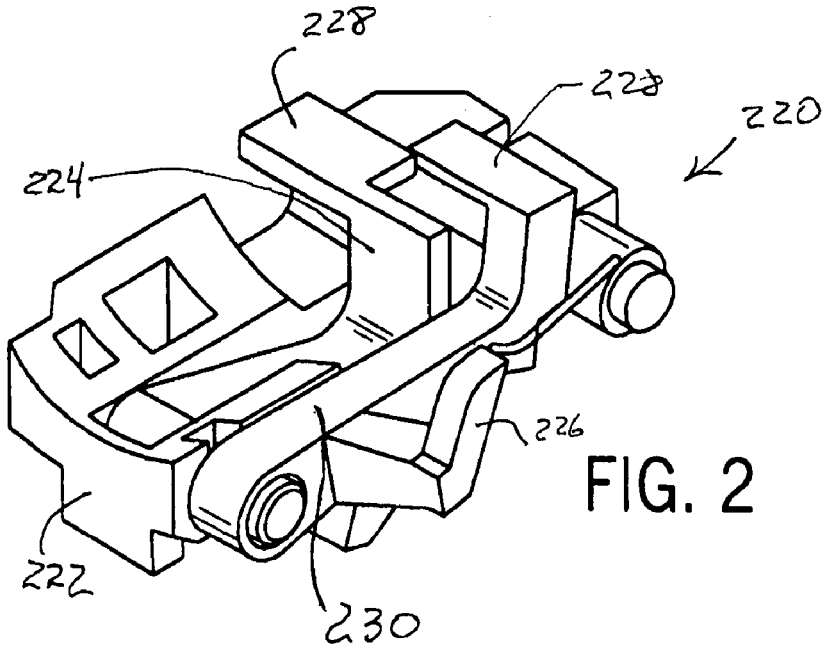
FIG. 2 is an exemplary embodiment of a mount assembly configured to engage and couple to the integrated maglatch assembly illustrated in FIG. 1.
Figure 3:
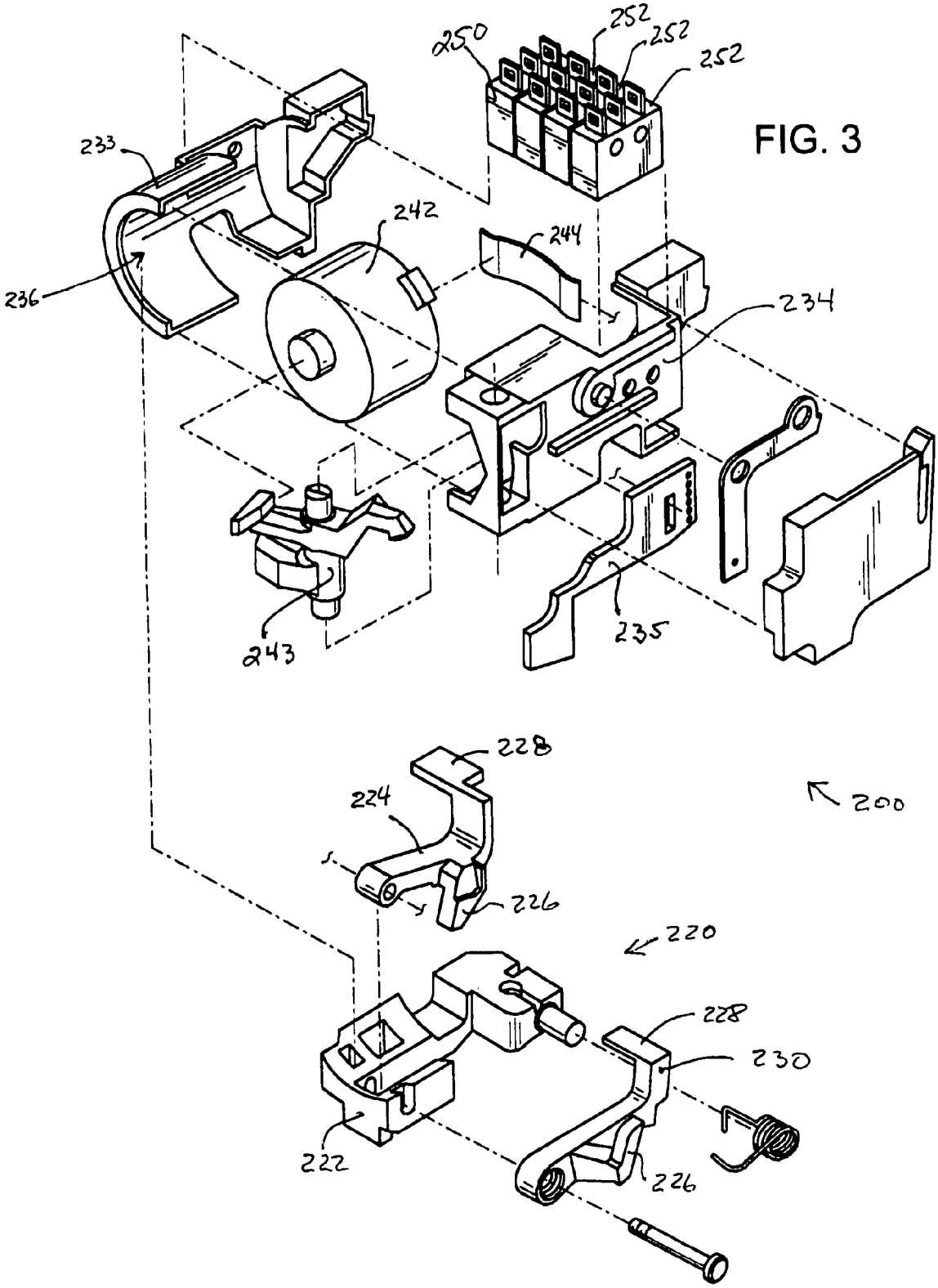
FIG. 3 is an exploded view of the magnetic latch assembly and mount assembly illustrated in FIGS. 1 and 2.

Referring to FIGS. 1 and 5, there is illustrated an integrated maglatch accessory 200 nested in an accessory socket 22 of a cover 20 of the circuit breaker 10. The accessory 200 illustrated consists of four switches 250, 252 and a magnetic latch device 240 disposed in a housing 232 mounted on a signal accessory mounting 220. Both the alarm switch 250 and each auxiliary switch 252 is a signaling device and are both of similar construction for interchangeability of parts. It should be understood that the accessory 200 can be configured to include three fewer switches. Two auxiliary switches can be combined with two alarm switches as illustrated in FIGS. 1 and 5. Each switch, 250, 252 is provided with terminals for connecting the switches to an internal circuit board 235 or to an external circuit provided by an operator. The wiring from the external circuit is passed through a wire channel in the circuit breaker 10 and connected to the respective terminals of the switches 250, 252. The switches 250, 252 can also be configured to couple only internally to the trip unit 60 or the operating mechanism 40 of the circuit breaker 10.

As illustrated in FIGS. 1-5, an apparatus 200 for indicating a condition of a molded case circuit breaker 10, with the circuit breaker 10 defining an accessory pocket 22 in communication with an operating mechanism 40 and a trip unit 60 with the circuit breaker is illustrated. The condition of the molded circuit breaker 10 to be indicated is one of the circuit breaker being on (closed) or off (open) or tripped.

The apparatus 200 includes a mount member 220 operatively coupled to one of the operating mechanisms 40 and trip units 60 in the accessory pocket 22. The mount member includes a base 222 coupled to the base is a switch actuator 224 that defines a switch lever 226 and a switch pad 228. The switch lever 226 engages the operating mechanism for the trip unit 60 as configured by an operator. The switch pad 228 is configured to operate one or more of the switches 250, 252 mounted in the magnetic latch and housing assembly. The base 222 also includes a bell alarm actuator 230. The bell alarm actuator 230 includes a switch pad 228 and a switch lever 226 configured to operate one or more of the switches 250 and 252. The switch actuator 224 and bell alarm actuator 230 are typically rotatably mounted with a pin to the base 220 and may include a biasing member such as a spring. The mount member 220 is configured to be disposed in the accessory pocket 222 defined in the circuit breaker housing 12 of the circuit breaker 10. The components of the mount member 220 can be composed of any suitable material compatible with the intended use, for example, electrically insulating material, plastic, composite material or any combination of such material.

The apparatus 200 also includes an integral maglatch. A housing 232 is coupled to the mount member 220 with the housing 232 defining a compartment 236. The housing typically includes a left side 233 and a right side 234 and configured to contain a magnetic latch 242 and the switches 250, 252 (which can be microswitches). The magnetic latch 242 also includes an over travel spring 244 and is configured to align with a reset lever 243 which is pivotably mounted in the maglatch housing 232. The components of the housing 232 can be composed of any suitable material compatible with the intended use, for example, electrically insulating material, plastic, composite material or any combination of such material.

A switch 250, 252 is disposed in the compartment 236 and operatively coupled to the mounting members 220 via the actuator 224 or 226.

The condition of the circuit breaker 10 is indicated by condition of one of the switch 250 and magnetic latch 242 and the condition of the circuit breaker is operatively transmitted via the apparatus 200 to a remote location 260. For example, if the circuit breaker is in a tripped condition, the trip indication is transmitted to a bell alarm by actuating one of the switches 250, 252 with the bell alarm actuator 226. If the condition of the circuit breaker 10 is either open or closed, the auxiliary switch 250, 252 is actuated by the switch actuator 224 sends a signal to an indicator, such as a light or bell or the like. The circuit breaker can be reset by the magnetic latch actuating the reset lever 246 which can also activate one of the switches 250, 252 to provide an appropriate signal to a remote location 260 as to the condition of the circuit breaker 10.

The switches 250, 252 are operatively connected to the trip unit 60 or the operating mechanism 40 by way of the actuator 224 and 230 which are in communication with the trip unit 60 and an operating mechanism 40 through openings in the accessory compartment 22 as described above.

By integrating the magnetic latch 242 and the switches 250, 252 into a single housing 232 disposed in one accessory compartment 222, additional accessories can be mounted in other open accessory compartments of the circuit breaker 10.

In one embodiment of the circuit breaker 10, the trip unit 60 is an electronic trip unit (ETU) and the apparatus 200 provides the ETU access to an auxiliary switch and a bell alarm in order to allow the ETU to determine if the circuit breaker 10 is open, closed or in a tripped condition. Additional switches can be used to provide a signal to a remote location 260 to indicate the condition of the circuit breaker. The integrated maglatch accessory provides the following options to an operator of the circuit breaker 10 an auxiliary switch can be configured to be accessible for external customer use only. Another auxiliary switch can be configured to be internally accessible to the trip unit, such as an ETU only for communication of whether or not the circuit breaker is in an open or closed position. Another switch can be coupled to a bell alarm and configured to be accessible for customer use only. Another switch can also be coupled to a bell alarm that is internally or externally accessible however an internal access would be limited to an ETU for communication of a circuit breaker trip condition.

It should be understood that the connections to the several switches 250, 252 can be configured with "flying leads" or with terminals configured to accept soldered wires as determined by a user.

For purposes of this disclosure, the term "coupled" means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components or the two components and any additional member being attached to one another. Such joining may be permanent in nature or alternatively may be removable or releasable in nature.

The present disclosure has been described with reference to example embodiments, however workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example is manifestly intended to be as broad as possible. For example, unless specifically otherwise noted a single particular element may also encompass a plurality of such particular elements.

It is important to note that the construction and arrangement of the Integrated Maglatch Accessory as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present inventions as expressed in the appended claims.

What is claimed is:

1. A circuit breaker comprising:

a circuit breaker housing defining at least one accessory pocket;

an operating mechanism disposed within the circuit breaker housing and operable to engage and disengage a first contact with a second contact;

an auxiliary accessory disposed in the accessory pocket and coupled to the operating mechanism, the auxiliary accessory including an accessory housing, and a magnetic latch and a plurality of status switches located within the accessory housing, the status of at least one of the plurality of switches changing in response to a change in state of the circuit breaker, the magnetic latch being activated based on an amount of current flowing through the circuit breaker; and a mounting member, wherein the auxiliary accessory is coupled to the operating mechanism via the mounting member, and wherein the mounting member is a separate component coupled to the accessory housing and includes a base, and first and second moveable switch actuators rotatably mounted to the base, each of the first and second switch actuators including a switch lever and a switch pad, wherein the first and second switch actuators are coupled to the operating mechanism and moveable by the operating mechanism to cause the switch pads to operate one or more of the plurality of switches and change a status of one or more of the switches.

2. The circuit breaker of claim 1, wherein at least one of the switches is configured to provide a signal to a bell alarm.

3. The circuit breaker of claim 1, wherein at least one of the switches is configured only for external access.

4. The circuit breaker of claim 1, wherein the accessory is configured to provide an indication of the state of the circuit breaker to a remote location.

5. An auxiliary accessory for a circuit breaker, the circuit breaker having a circuit breaker housing that defines at least one accessory pocket, the auxiliary accessory comprising:

an accessory housing;

a magnetic latch located within the housing, the magnetic latch being activated based on a current flowing through the circuit breaker;

a plurality of switches located within the housing, the switches indicating a change in status of the circuit breaker; and a mounting member including a base, and a first and second switch actuator rotatably mounted to the base, each of the first and second switch actuators including a switch lever and a switch pad, the first and second switch actuators coupled to an operating mechanism of the circuit breaker to cause a change in the status of at least one of the plurality of switches upon change in status of the circuit breaker; wherein the accessory housing is mounted within the accessory pocket via the mounting member and wherein the mounting member is a separate component coupled to the accessory housing.

6. The accessory of claim 5, wherein one of the switches is configured to provide a signal to a bell alarm.

7. The accessory of claim 5, wherein at least one of the switches is configured only for external access.

8. The accessory of claim 5, wherein the accessory is configured to provide an indication of the state of the circuit breaker to a remote location.

9. A method of installing an auxiliary accessory in a circuit breaker, comprising:

providing a circuit breaker having an accessory pocket and an operating mechanism operable to selectively engage and disengage a first contact with a second contact;

mounting an auxiliary accessory within the accessory pocket, the auxiliary accessory including an accessory housing containing a magnetic latch and a plurality of switches, the magnetic latch being activated based on a current flowing through the circuit breaker; and coupling the auxiliary accessory to the operating mechanism such that at least one of the plurality of switches indicates a change in state of the circuit breaker;

wherein the auxiliary accessory is mounted within the accessory pocket via a mounting member, wherein the mounting member is a separate component coupled to the accessory housing and includes a base and first and second moveable switch actuators rotatably mounted to the base, each of the first and second moveable switch actuators including a switch lever and a switch pad, the first and second moveable switch actuators being coupled to the operating mechanism and moveable by the operating mechanism to change the status of at least one of the switches.

10. The method of claim 9, wherein one of the switches is configured to provide a signal to a bell alarm.

11. The method of claim 9, wherein at least one of the switches is configured only for external access.

12. The method of claim 9, wherein the accessory is configured to provide an indication of the state of the circuit breaker to a remote location.

13. The circuit breaker of claim 1, wherein the plurality of status switches includes a bell alarm switch and an auxiliary switch, the bell alarm switch indicating whether the circuit breaker has been tripped, and the auxiliary switch indicating whether a connection between the first contact and the second contact is one of open and closed; and wherein the first and second switch actuators includes a bell alarm switch actuator and an auxiliary switch actuator, the auxiliary switch actuator engaging a crossbar of the operating mechanism.

* * * * *